United States Patent [19]

Suzuki et al.

[11] 4,363,559

[45] Dec. 14, 1982

[54] PRINT WHEEL MOUNTING ASSEMBLY FOR SERIAL PRINTER

[75] Inventors: Takami Suzuki, Yokohama; Takashi Hasegawa, Isehara, both of Japan

[73] Assignee: Ricoh Co., Ltd., Japan

[21] Appl. No.: 210,841

[22] Filed: Nov. 26, 1980

Related U.S. Application Data

[63] Continuation of Ser. No. 6,214, Jan. 24, 1979, abandoned.

[30] Foreign Application Priority Data

Jan. 24, 1978 [JP] Japan ..... 53-5783
Jan. 24, 1978 [JP] Japan ..... 53-5784

[51] Int. Cl.[3] ..... B41J 1/24

[52] U.S. Cl. ..... 400/175; 400/144.2; 400/144.3

[58] Field of Search ..... 400/144.2, 144.3, 175; 403/201, 263, 325, 327

[56] References Cited

U.S. PATENT DOCUMENTS 3,878,929 4/1975 Orlens et al. ..... 400/175
3,983,985 10/1976 Guerrini et al. ..... 400/144.2
3,986,593 10/1976 Orlens et al. ..... 400/144.2
4,036,348 7/1977 Guerrini ..... 400/144.2
4,049,110 9/1977 Frechelke ..... 400/144.2 X

FOREIGN PATENT DOCUMENTS 925363 5/1963 United Kingdom .
1367749 9/1974 United Kingdom .
1414592 11/1975 United Kingdom .
1419737 12/1975 United Kingdom .

OTHER PUBLICATIONS

McCray, IBM Tech. Discl. Bulletin, vol. 18, No. 9, Feb., 1976, pp. 2988–2989.

*Primary Examiner*—Edward M. Coven
*Attorney, Agent, or Firm*—McGlew and Tuttle

[57] ABSTRACT

A print wheel mounting assembly for a serial printer comprising means for transmitting a torque from a rotary shaft to a print wheel, means for positioning the print wheel in the direction of its rotation and means for regulating the position of the print wheel axially thereof, whereby no special tool is required for mounting or detaching the print wheel on the rotary shaft.

10 Claims, 6 Drawing Figures

PRINT WHEEL MOUNTING ASSEMBLY FOR SERIAL PRINTER

This is a continuation, of application Ser. No. 006,214 filed Jan. 24, 1979, now abandoned.

BACKGROUND OF THE INVENTION

This invention relates to a print wheel mounting assembly for a serial printer comprising a print wheel including a number of spokes radially outwardly extending from a hub in the center of the print wheel and each having at least one type element mounted thereon.

Heretofore, a type wheel, a type ball or a type pallet has been in use as a type element carrier of a serial printer. Such type element carrier is generally mounted on a type element selecting rotary shaft by means of a nut, a screw or a support ring and requires a screw driver, a wrench or a special tool for mounting or detaching same. Proposals have been made to use a print wheel mounting assembly including a special tool for mounting and clamping a print wheel assembled into the serial printer so as to eliminate the need to use a special tool for mounting or detaching the print wheel. For example, Japanese Laid-Open Patent Application No. Sho-51-70017 discloses a print wheel mounting assembly including a spring, a pin and a locking member connected to a type element selecting rotary shaft. This print wheel mounting assembly has disadvantages in that its construction is complex, that the print wheel tends to become wobbly axially thereof, and that difficulties are encountered in accurately positioning the print wheel. Other print wheel mounting assemblies known in the art include a cylindrical portion having inserted therein a type element selecting rotary shaft and attached to the hub of the print wheel to be clamped by a spring from outside or having resiliently force fitted therein a type element selecting rotary shaft. These assemblies all have the disadvantages that the axial position of the type element selecting rotary shaft is unstable, and that there is a possibility that the repeated printing of characters will cause dislodging of the print wheel from the forward end of the shaft.

SUMMARY OF THE INVENTION

This invention has as its object the provision of a print wheel mounting assembly for a serial printer which eliminates the aforesaid disadvantages of the prior art.

To accomplish the aforesaid object, the invention proposes to provide torque transmitting means, means for positioning the print wheel in the direction of its rotation, and means for regulating the position of the print wheel axially thereof, such means being interposed between a clamp disk attached to the print wheel and a receiver plate secured to the type element selecting rotary shaft. By using this mechanism, no special tool is required for mounting or detaching the print wheel, and detachable mounting of the print wheel can be facilitated. Since the axial position of the print wheel is regulated, there is no risk of the print wheel being dislodged from the rotary shaft.

Other and additional objects, features and advantages of the invention will become apparent from the description set forth hereinafter when considered in conjunction with the accompanying drawings.

PREFERRED EMBODIMENTS OF THE INVENTION

Figure 1:
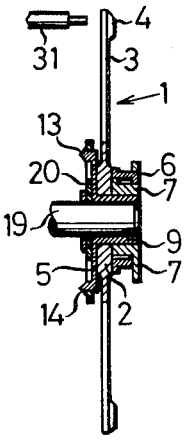
FIG. 1 is a sectional view of the print wheel mounting assembly comprising one embodiment of this invention and showing the print wheel unit mounted on the rotary shaft.
Figure 2:
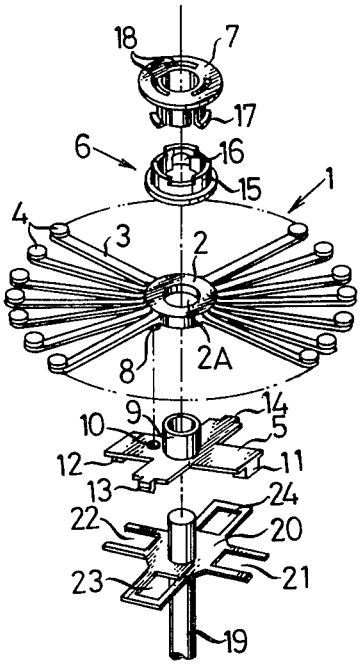
FIG. 2 is an exploded perspective view of the print wheel mounting assembly illustrated in FIG. 1.
Figure 3:
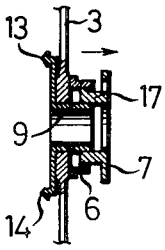
FIG. 3 is a sectional view of the mounting assembly illustrated in FIG. 1, showing the essential portions thereof.

Preferred embodiments of the invention will now be described by referring to the accompanying drawings. In FIGS. 1 and 2, a print wheel 1 includes a hub 2, and a number of spokes 3 radially outwardly extending from the hub 2. The spokes 3 each have a type element 4 mounted on the forward end thereof. The print wheel 1 is assembled with a clamp disk 5, a setter 6 and a knob 7 to be unitary in the factory, to provide a print wheel unit as shown in FIG. 3. The hub 2 of the print wheel 1 is formed with a center opening 2A and has a print wheel positioning projection 8 formed on a side thereof which is juxtaposed against the clamp disk 5.

The clamp disk 5 includes a cylindrical portion 9 to be fitted in the center opening 2A in the hub 2, and a print wheel positioning opening 10 to receive the projection 8 therein. The clamp disk 5 further includes positioning projections 11 and 12 disposed in diametrically opposed positions on a side thereof which is remote from the print wheel 1, and resiliently formed locking arms 13 and 14 disposed in diametrically opposed positions on an imaginary line disposed normal to the imaginary line interconnecting the locking arms 11 and 12. The setter 6 includes a central cylindrical portion with three projections 15 disposed equidistantly along the circumference and extending axially thereof, and elongated setter grooves 16 disposed inwardly of the projections 15. The setter 6 is bonded to the print wheel 1 either adhesively or by means of ultrasonic welding.

The knob 7 includes resilient setter locking arms 17 to be received in the setter grooves 16 of the setter 6, and slots 18 for receiving the projections 15 of the setter 6.

Meanwhile a type element selecting rotary shaft 19 has secured thereto a receiver plate 20 formed with positioning indentations 21 and 22 for receiving the positioning projections 11 and 12 respectively of the clamp disk 5, and locking openings 23 and 24 for receiving the locking arms 13 and 14 of the clamp disk 5.

The cylindrical portion 9 of the clamp disk 5 is inserted in the center opening 2A of the hub 2 of the print wheel 1 and the setter 6 bonded to the hub 2, and the knob 7 is fitted over the forward end of the cylindrical portion 9, the locking arms 17 of the knob 7 being received in the setter slot 16. The setter locking arms 17 are movable along the elongated setter slot 16, so that the knob 7 can be moved between a pushed-in position shown in FIG. 1 and a pulled-out position shown in FIG. 3. When the knob 7 is in the pushed-in position shown in FIG. 1, the projections 15 of the setter 6 are engaged in the corresponding slots 18 in the knob 7. Then the positioning projections 8 on the hub 2 of the print wheel 1 is fitted in the positioning opening 10 of the clamp disk 5. Thus the print wheel 1, clamp disk 5, setter 6 and knob 7 are rendered unitary. This assembling operation is performed in the factory.

The aforesaid print wheel unit is fitted on the type element selecting rotary shaft 19 secured to the center of the receiver plate 20 by inserting the shaft 19 in the cylindrical portion 9 in sliding movement, until the positioning projections 11 and 12 of the clamp disk 5 are engaged in the positioning indentations 21 and 22 respectively of the receiver plate 20. Further moving the shaft 19 through the cylindrical portion 9 results in the tapering portions V-shaped projections of the resiliently formed locking arms 13 and 14 entering the locking openings 23 and 24 in the receiver plate 20 until the forward ends of the locking arms 13 and 14 resiliently engage the edges of the locking openings 23 and 24 respectively, thereby locking the print wheel unit and preventing its axial movement. When the print wheel unit is thus mounted on the shaft 19, all the parts of the print wheel unit are disposed concentrically about the same center line with respect to the rotary shaft 19. FIG. 1 also shows a print hammer 31.

By fitting the print wheel positioning projection 8 in the positioning opening 10, the relative positions of the print wheel 1 and clamp disk 5 are determined. By bringing and positioning projections 11 and 12 into engagement in the positioning indentations 21 and 22 respectively, the relative positions of the clamp disk 5 and the receiver plate 20 and hence the type element selecting rotary shaft 19 are determined. In this case, it is possible to prevent misoperation in mounting the print wheel unit on the rotary shaft 19 by varying the sizes of the projection 11 and indentation 21 and the projection 12 and indentation 22. Thus the relative positions of all the type elements 4 on the print wheel 1 and the rotary shaft 19 are determined. The engagement of the positioning projections 11 and 12 in the positioning indentations 21 and 22 respectively enables the transmission of a torque from the receiver plate 20 to the clamp disk 5.

By affixing a resilient member to the edge of each of the locking opening 23 and 24 in which the locking arms 13 and 14 are engaged respectively, it is possible to compensate for any variations in the dimensions of the parts which might occur when the parts are fabricated.

When depressed, the knob 7 moves in sliding motion along the setter grooves 16 and the setter locking arms 17 expand owing to their own elasticity as the movement of the knob 7 reaches its end, thereby giving the feel of having accomplished the mounting to the operator. In detaching the print wheel assembly from the rotary shaft 19, the knob 7 is first pulled by hand. This causes only the knob 7 to be lifted along the setter grooves 16 on the inner wall surfaces of the setter 6 to a level high enough to enable the operator to grip the knob firmly. By gripping and pulling strongly on the knob 7, i.e. in a direction away from the rotary shaft 19, or in the opposite axial direction used for pushing the print wheel unit into mounted and attached position on such rotary shaft, the locking arms 13 and 14 are released from engagement in the locking openings 23 and 24 by virtue of their resilience and the tapering thereof, enabling the print wheel unit to be detached from the rotary shaft 19.

Thus, inherently axial positioning means are provided which include axially operated radially displaceable locking means, e.g. locking arms 13 and 14 provided with tapering portions or V-shaped projections for resiliently engaging the edges of the locking openings 23 and 24, which are disposed in axially spaced or remote relation to the central hub 2 and operatively arranged for locking the print wheel 1 to the rotary shaft 19 for preventing relative axial movement therebetween upon pushing the print wheel axially to a locking engagement position (cf. FIG. 2) on the rotary shaft and for unlocking the print wheel from the rotary shaft for detaching the print wheel from the rotary shaft upon pulling the print wheel axially away from said locking engagement position.

In this regard, the knob 7 is accordingly attached to the central hub 2 of the print wheel 1 for pushing the print wheel axially for mounting the print wheel on the rotary shaft 19 and for pulling the print wheel axially for detaching the print wheel from the rotary shaft, the knob being formed separately from the torque transmitting means, i.e., as contemplated by the coacting clamp disk 5 and receiver plate 20 parts, and being mounted for sliding movement between an axially retracted or pushed-in pushing position (cf. FIG. 1) and an axially extended or pulled-out pulling position (cf. FIG. 3), e.g. movably mounted in axially slidable relation with respect to the print wheel.

Figure 4:
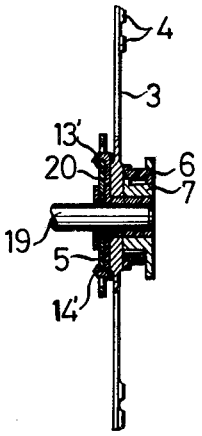
FIG. 4 is a sectional view similar to FIG. 1 but showing another embodiment of the invention.

FIG. 4 shows another embodiment of the invention which is similar to the embodiment shown in FIGS. 1 and 2 except that the locking arms 13' and 14' of the clamp disk 5 face inwardly to engage the radially inner edges of the locking openings 23 and 24 of the receiver plate 20.

Figure 5:
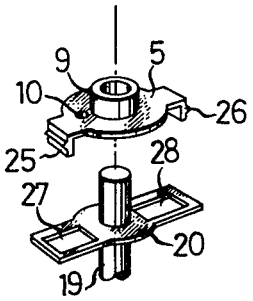
FIG. 5 is an exploded perspective view of still another embodiment, showing its essential portions.

FIG. 5 shows still another embodiment of the invention in which the locking arms 25 and 26 of the clamp disk 5 perform the functions of both the positioning projections 11 and 12 and the locking arms 13 and 14 of the embodiment shown in FIGS. 1 and 2. Thus the locking openings 27 and 28 of the receiver plate 20 in which the locking arms 25 and 26 are engaged respectively also perform the functions of both the positioning indentations 21 and 22 and the locking openings 23 and 24 of the latter embodiment. By this arrangement, the clamp disk 5 and the receiver plate 20 of this embodiment are simpler in construction than the equivalent parts of the embodiment shown in FIGS. 1 and 2.

Figure 6:
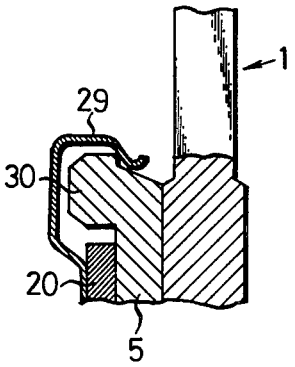
FIG. 6 is a fragmentary view showing a further embodiment.

FIG. 6 shows a further embodiment in which the receiver plate 20 has mounted thereon a resilient plate spring 29 which is locked by the locking arm 30 of the clamp disk 30. In this embodiment, the locking arm 30 need not be formed resiliently.

From the foregoing description, it will be appreciated that the print wheel mounting assembly according to the invention enables the axial position of the print wheel to be regulated, as contrasted with print wheel mounting assemblies of the prior art which have been unable to perform this function, so that there is no risk of the print wheel being dislodged from the rotary shaft when printing of the characters is carried out. Also, the print wheel mounting assembly according to the invention permits the print wheel unit to be maintained in engagement with the rotary shaft 19 in a stable manner with respect to vibrations in the direction of rotation, by virtue of the engagement of the positioning projections of the clamp disk in the positioning indentations of the receiver plate. Moreover, since the knob 7 can be pulled out, the print wheel unit can be readily detached from the rotary shaft 19 by gripping the knob 7 firmly.

While the invention has been described as being applied to a print wheel of the daisy type, it is to be understood that the invention is not limited to this specific form of the print wheel and that the invention can also have application in a bell type print wheel, for example.

What is claimed is:

1. A print wheel mounting assembly for a serial printer comprising a rotary shaft and a print wheel to be mounted on the shaft, the print wheel including a central hub, a number of spokes extending radially outwardly from the hub, and at least one type element on each spoke, said assembly comprising: torque transmitting means operatively interconnecting the rotary shaft and the print wheel for transmitting torque from the rotary shaft to the print wheel, said torque transmitting means comprising a receiving plate secured to the shaft, and a clamp disk attached to the print wheel operatively connected to said receiving plate, locating means for positioning the print wheel in a predetermined angular position on the rotary shaft, axial positioning means for controlling the axial position of the print wheel on the shaft, said locating means and said axial positioning means being arranged in both the clamp disk and the receiving plate, said print wheel including a setter member having a cylindrical portion fixedly connected in concentric relationship to the central hub, said cylindrical portion of said setter member having a plurality of circumferentially spaced setter projections extending axially relative to said hub, each of said setter projections having elongated setter grooves disposed inwardly thereof, and further comprising a knob movably mounted in said cylindrical portion of said setter member in axially slidable relationship with respect to the print wheel between two axially spaced positions, said knob including a plurality of circumferentially spaced setter locking arms extending axially thereof, each of said setter locking arms being slidably disposed in one of said setter grooves, and said knob being attached to the central hub of said print wheel to be concentric therewith for mounting the print wheel on the rotary shaft and for detaching the print wheel from the rotary shaft.

2. A print wheel mounting assembly as set forth in claim 1, wherein the torque transmitting means and the locating means for positioning the print wheel in a predetermined angular position comprise positioning projections formed in one of said clamp disk and said receiving plate and positioning indentations formed in the other of said clamp disk and said receiving plate for receiving said positioning projections in engaging relation, and said axial positioning means for controlling the axial position of the print wheel on the shaft comprises locking arms formed in one of said clamp disk and said receiving plate and locking openings formed in the other of said clamp disk and said receiving plate for receiving said locking arms in locking relation.

3. A print wheel mounting assembly as set forth in claim 2, wherein said positioning projections and positioning indentations are spaced uniformly about the axis of said shaft.

4. A print wheel mounting assembly as set forth in claim 3, wherein one of said clamp disk and said receiving plate comprises a plurality of outwardly extending arms uniformly spaced around the axis of said shaft, and one of said positioning projections and one of said locking arms is formed on each of said outwardly extending arms.

5. A print wheel mounting assembly as set forth in claim 3, comprising a first set of outwardly extending arms uniformly spaced around the axis of said shaft in one of said clamp disk and receiving plate, each of said positioning projections being formed on said first set of arms, and a second set of arms uniformly spaced around the axis of said shaft in one of said clamp disk and receiving plate and angularly space from said first set of arms, each of said locking arms being formed on one of the arms of said second set of arms.

6. A print wheel mounting assembly as set forth in claim 2, in which said locking arms are resilient and resiliently engage said locking openings.

7. A print wheel mounting assembly as set forth in claim 2, in which said locking openings are defined by resilient edges in one of said clamp disk and said receiving plate and said locking arms engage said resilient edges.

8. A print wheel mounting assembly as set forth in claim 1, wherein said print wheel includes one of a projection and opening provided at said central hub, and said clamp disk includes one of a print wheel positioning opening and projection for matingly engaging said projection and opening of said print wheel for positioning said print wheel to said clamp disk.

9. A print wheel mounting assembly as set forth in claim 8, wherein said center hub includes a central opening, and said clamp disk includes a cylindrical portion at its center fitted in said center opening in the hub of the print wheel.

10. A print wheel mounting assembly as set forth in claim 8, wherein said cylindrical portion of the clamp disk is inserted on the rotary shaft.

* * * * *